United States Patent [19]

Gaillard et al.

[11] Patent Number: 4,722,513

[45] Date of Patent: Feb. 2, 1988

[54] CRASH BARRIERS FOR ROADS AND HIGHWAYS

[75] Inventors: Christian C. Gaillard; Thierry G. Papineschi, both of Beziers, France

[73] Assignee: "Compagnie Francaise Des Establissements Gaillard", Beziers, France

[21] Appl. No.: 941,654

[22] Filed: Dec. 15, 1986

[30] Foreign Application Priority Data

| | | | |
|---|---|---|---|
| Dec. 23, 1985 | [FR] | France | 85 19226 |
| Apr. 8, 1986 | [FR] | France | 86 05098 |
| May 2, 1986 | [FR] | France | 86 06497 |

[51] Int. Cl.[4] ..... A01K 3/00

[52] U.S. Cl. ..... 256/13.1; 256/65; 248/66

[58] Field of Search ..... 256/13.1, 65; 248/66

[56] References Cited

U.S. PATENT DOCUMENTS

| | | | |
|---|---|---|---|
| 1,493,088 | 5/1924 | Van Epps | 256/13.1 |
| 2,085,058 | 6/1937 | Wood | 256/13.1 |
| 2,898,090 | 8/1959 | Rasmussen | 256/13.1 |
| 3,082,994 | 3/1963 | Rasmussen | 256/13.1 |
| 3,194,537 | 7/1965 | Gerin | 256/13.1 |
| 3,989,226 | 11/1976 | Burgess | 256/65 |

FOREIGN PATENT DOCUMENTS

| | | | |
|---|---|---|---|
| 1295582 | 5/1969 | Fed. Rep. of Germany | 256/13.1 |
| 2573105 | 5/1986 | France . | |
| 652365 | 2/1963 | Italy | 256/13.1 |

*Primary Examiner*—Andrew V. Kundrat

*Attorney, Agent, or Firm*—Bucknam and Archer

[57] ABSTRACT

The invention relates to crash barriers for roads or highways comprising a horizontal guard rail supported by posts. The guard rail and the posts are made up of wooden poles. The rail elements are assembled end to end by means of two fish-plates which are disposed on either side of the poles and across the junction between two poles, said fish-plates being secured by bolts traversing the two fish-plates and one pole.

11 Claims, 8 Drawing Figures

CRASH BARRIERS FOR ROADS AND HIGHWAYS

The present invention relates to crash barriers for roads and highways.

The known crash barriers are installed on the side of roads or highways, for stopping any vehicles which accidentally leave the road.

These crash barriers comprise one or more horizontal guard rails laid on posts anchored in the ground.

Generally, these guard rails are metal sections and are supported by metallic poles.

Other known crash barriers are made of wood and have one or more guard rails in wood supported by wooden posts.

Each guard rail is composed of identical elements assembled end to end.

U.S. Pat. No. 4,085,058 (WOOD) describes guard fences for highways in which the guard rails comprise a plurality of wood laminations and loops of cable engaged in grooves. The adjacent ends of two guard rail elements are equipped with metal pieces over which pass the loops of cables, a bolt which traverses the metal pieces and the loops of cables, fixing the guard rail on a post.

U.S. Pat. No. 1,493,088 (VAN EPPS) describes highway guard fences which comprise wooden railings resting on wooden posts.

U.S. Pat. No. 3,989,226 (BURGESS) describes guard rails made of planks joined together end to end by two channel plates secured to a post by a bolt.

Wooden crash barriers are less expensive than metal ones and they fit in better with the countryside.

Nevertheless, crash barriers for highways must follow the norms of impact strength in order to be acceptable.

In particular, the guard rails must be able to withstand a specific tractive force, for example of the order of 200 KN, and the problem which then arises is to produce an end to end assembly of the guard rails which will not risk to catch on any vehicle sliding along a rail, and which will be able to withstand the level of forces imposed by the regulations.

It is the object of the present invention to propose crash barriers for installing alongside roads, of the type comprising in known manner, at least one horizontal wooden guard rail which is composed of elements assembled end to end and supported by wooden posts.

The object of the invention is reached with a crash barrier comprising a guard rail which is composed of wooden poles, each one having two ends, the adjacent ends of which poles are assembled together end to end by means of two fish-plates consisting of two rectangular metal plates, elongated and flat, placed on either side of the poles, in the horizontal plane traversing their axis and across the junction between two poles, the fish-plates comprising a plurality of holes for receiving bolts which go through the plates and one of said poles and, on each one of which is screwed a nut.

Advantageously, each wooden pole comprises a longitudinal groove situated on the road side and having a width and depth slightly more than the width and thickness of the metallic plates, one of said two metallic plates being housed in said groove.

According to a preferred embodiment of the invention, each fish-plate is provided, on its internal face, with cramping members, each one comprising a pair of small thin metal strips situated in planes perpendicular to that of the fish-plate, and each cramping member is associated to one of the holes and is for the main part situated on the same side of said hole as the longitudinal middle of the fish-plate, so that the two small strips of each cramping member penetrate into the wood of the pole when the fish-plate is in position, and tightens the fibers of said wood, the result being to prevent the wood from splitting when a tractive force is exerted on the fish-plate.

The two small strips of each pair form together an angle varying between 0° and 120°.

Advantageously, the free edge of each plate is a cutting edge.

The invention has resulted in a new type of crash barriers for roads and highways.

The crash barriers according to the invention which are composed of wooden poles have the advantage of being inexpensive to produce and of fitting in more harmoniously with mountainous or rustic sceneries than the conventional metallic fences.

The advantage of the guard rails, made up of poles of constant diameter, is that if any vehicle hits the crash barrier, it will slide along it until it comes to a stop or until it is sent back onto the road, which contributes to reducing the gravity of accidents.

The assembly of the guard rail elements according to the invention by means of two fishplates, one of which, on the road side is contained in a groove, creates no unevenness on the surface of the barrier. Such assemblies cost little in materials and in the preparation and installation of the wood.

With the fish-plates according to the invention, which are equipped on their inner face with small metal strips parallel to the fibers of the wood, or converging towards the bolt holes, it is possible to avoid, reliably and cheaply, that the wood split under the action of the bolts whenever the crash barriers are subjected to a strong tractive force.

Laboratory tests have shown that the barriers equipped with such small strips could withstand tractive forces of 200 kilonewtons.

The crash barriers according to the invention comprise posts and rails made up of wood poles, preferably poles of constant diameter, and the diameter of the posts is smaller than the diameter of the rails, so that in the case of an impact, a certain number of posts break while absorbing the energy of the impact but without the rail breaking. The rail elements, on the other hand, being held firmly together by the fish-plates, remain assembled, this preventing the risk of accidents due to sections of rails coming loose and crashing into the damaged car or being projected onto the road.

The guard rail becomes elastically deformed under the impact and remains suspended to the posts which are still in position on both sides of the spot where the accident has occurred, substantially at the same height above the ground.

The crash carriers according to the invention are easily repaired after an accident and repairs are inexpensive.

The invention will be more readily understood on reading the following description with reference to the accompanying drawings, in which.

Figure 1:
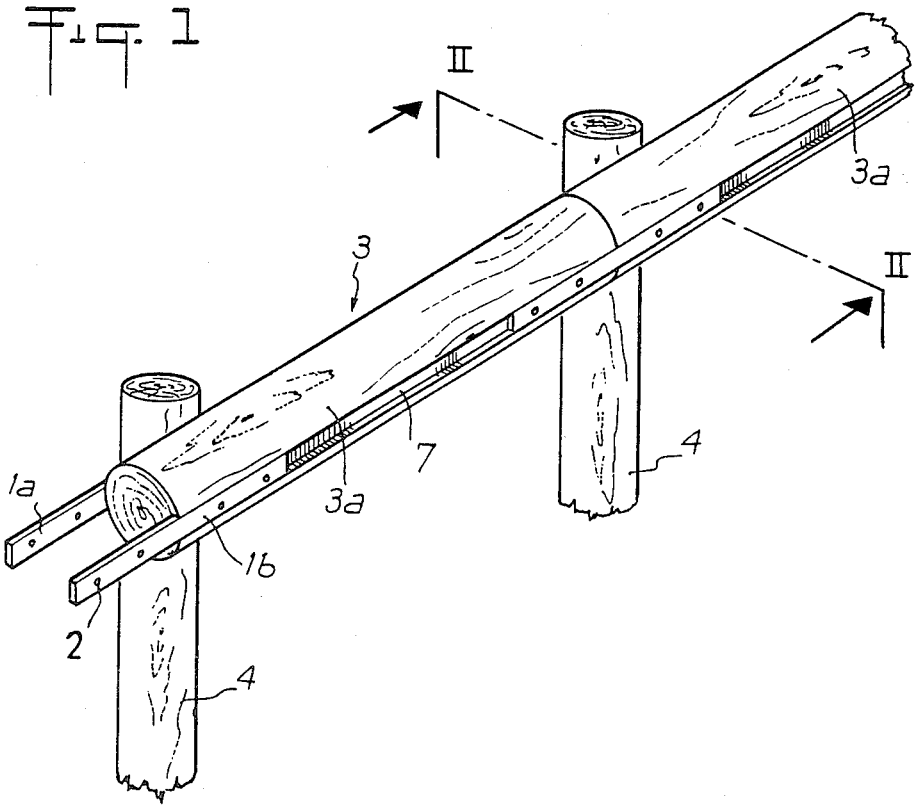
FIG. 1 is a perspective view of a portion of crash barrier according to the invention.
Figure 2:
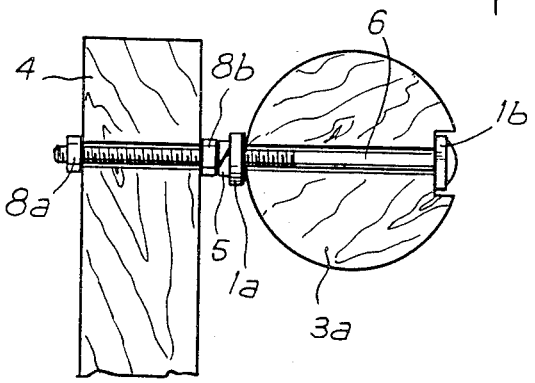
FIG. 2 is a cross-section along line II—II of FIG. 1.

Referring now to the drawings, FIGS. 1 and 2 represent a portion of crash barrier according to the invention. The barrier comprises wooden posts 4 supporting a horizontal guide rail 3 which is composed of elements 3*a* assembled end-to-end. The posts 4 and rail elements 3*a* are made up of wooden poles.

Advantageously, the rail elements are wooden poles of constant diameter, for example a diameter of 16, 18 or 20 cm and of length between 1.50 m and 4 m.

Preferably, the posts 4 are also wooden poles having a constant diameter of 12, 13 or 14 cm. They are therefore smaller than the rail elements, so that in case of an impact, they break first, thus absorbing part of the force of the impact.

The height aboveground of the posts 4 is around 80 cm, so that the rails are placed at the prescribed height of 70 cm above the ground.

The wooden poles making up the rails and the posts are injected, namely they are treated with wood-preserving agents such as creasote or other equivalent liquids injected into the wood.

The adjacent ends of two poles are joined together end to end by two fish-plates 1*a*, 1*b* which are flat metallic plates of elongated rectangular shape.

For example, fish-plates 1*a*, 1*b* are flat galvanized iron bars of length between 500 and 1000 mm, of width between 60 and 80 mm and of thickness between 6 and 10 mm. Each fish-plate is perforated with several holes 2, for example 4 holes, which are symmetrical in pairs with respect to the middle of the fish-plate. The two fish-plates 1*a*, 1*b* are placed on either side of the poles, in the horizontal plate traversing the axis of said poles and across the junction between two poles.

The two fish-plates are each secured to two poles by bolts 6, each bolt passing through the hole 2 of two fish-plates situated opposite each other and traversing one of the poles, and by a nut which is screwed on the threaded portion of the bolt situated on the side opposite to the road. Said bolts 6 may be squared-collar and rounded-head bolts of 16 mm diameter.

FIGS. 1 and 2 illustrate one preferred embodiment of the invention in which each pole is provided with a longitudinal groove 7, situated on the road side, along the generatrix of the pole closest to the road. The groove 7 has a width and a depth which are slightly more than the width and thickness of the fish-plates 1*a*, 1*b* and fish-plate 1*b*, which is situated on the road side, is entirely contained inside the groove 7, together with the heads of the bolts 6 so that, any vehicle sliding along the rail, will not hit on metallic parts projecting from the rail surface.

According to the embodiment illustrated in FIG. 1, the groove 7 extends through the entire length of the poles, for easy production purposes. As a variant, each pole may comprise two grooves in alignment which are situated at each end of the pole and whose length is slightly more than half the length of a fish-plate.

FIG. 2 illustrates a cross-section along line II—II of FIG. 1 cutting through the axis of a post 4.

The guard rail 3 is fitted on the front of the posts. In this example, one of the ends of each pole 3*a* is secured to a post 4 by one of the bolts 6 which is long enough to go through successively a fish-plate 1*b*, a pole 3*a*, a second fish-plate 1*a* and the post 4.

An elastic play-compensating washer 5 is inserted between the rear fish-plate 1*a* and a first nut 8*b* situated between the post and the rear fish-plate 1*a*.

A second nut 8*a* is screwed on the rear end of the bolt 6 and comes in abutment against the post 4.

Figure 8:
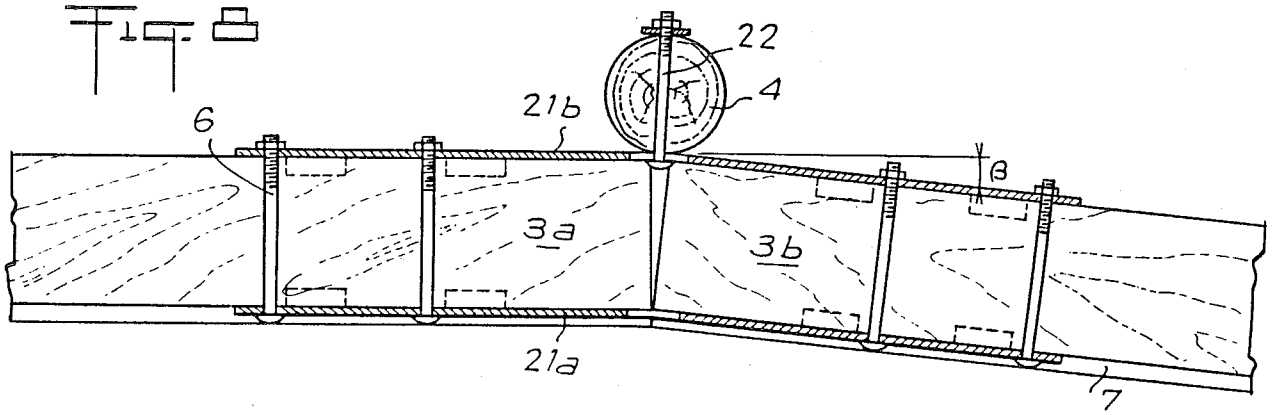
FIG. 8 is a horizontal section of one element of barrier according to the invention placed in a curve.

According to another variant illustrated in FIG. 8, the rail is secured to the posts 4 by bolts 22, of which the head rests only on the rear fish-plate 21*b*.

When a car hits on element from the rail, it exerts on said element a strong force which is transmitted to the other elements by the fish-plates and the bolts.

The compression forces are not a danger since each pole rests against the next pole, and since wood stands up well to compression.

Tractive forces, on the contrary, have the effect of causing the bolts to sink in between the fibers of the poles, and in doing so to split the wood, in similar manner to a wood-splitting wedge.

During the tests, the rails are made to withstand predetermined tractive forces, such as for example tractive forces of 200 KN, and the problem arising is to make the assemblies between poles strong enough to withstand such forces without the poles splitting.

Figure 3:
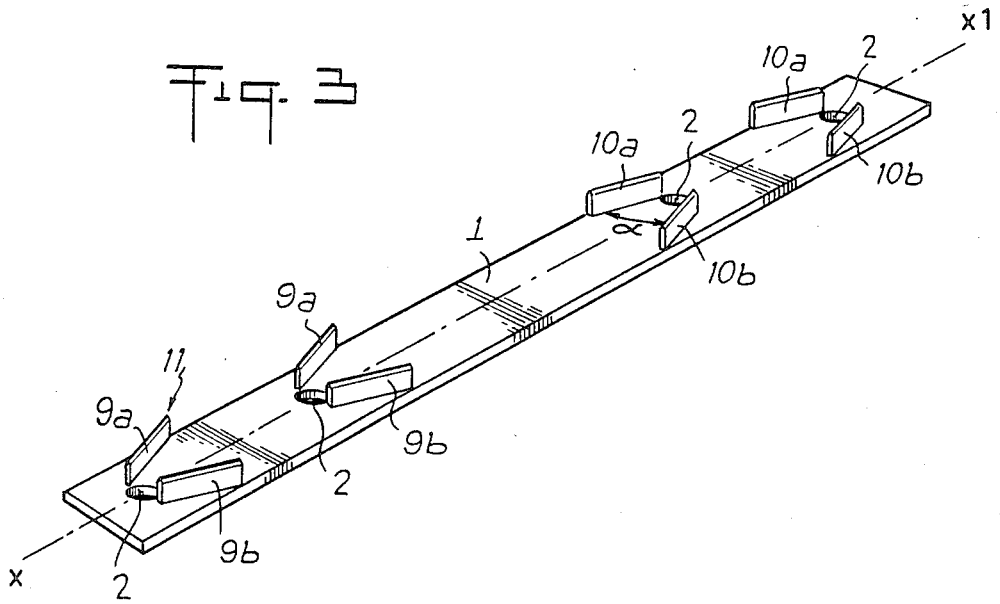
FIG. 3 is a rear view showing the rear face of a first embodiment of the fish-plate according to the invention.
Figure 4:
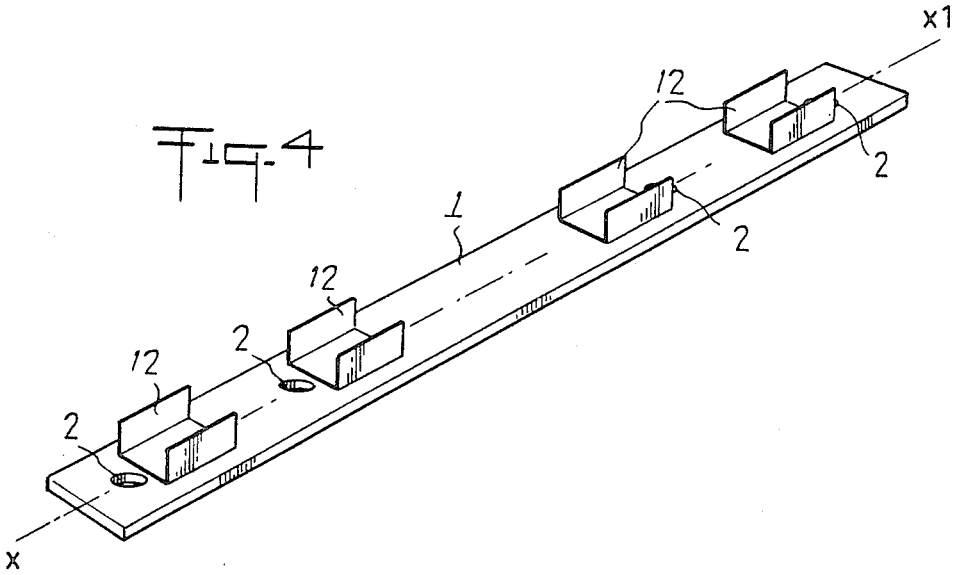
FIG. 4 is a perspective view of the rear face of a second embodiment of a fish-plate according to the invention.

FIGS. 3 and 4 are perspective views of the internal face of a fish-plate 1 according to the invention, i.e. the face which is applied against the wood.

Said face comprises means which are associated to each hole 2 and which are designed to close up the fibers of the wood in order to avoid that the bolt, which traverses the hole 2 causes the wood to split.

According to the embodiment illustrated in FIG. 3, the fish-plate 1 comprises cramping members, each constituted by a pair of small metal strips 9*a*, 9*b*, and 10*a*, 10*b* situated in planes perpendicular to the plane of fish-plate 1.

Each cramping member is associated to a hole 2 and is entirely or only partly placed on the side of the hole opposite the end of the nearest fish-plate 1, namely between holes 2 and the middle of plate 1, i.e. the middle in the longitudinal direction.

The two small metal strips forming each cramping member are convergent one towards the other in the direction of the end of the plate 1 which is the nearest. The small strips of each cramping member are symmetrical with respect to the longitudinal axis x–x1 of plate 1.

The angle $\alpha$ formed by the two small strips of each cramping member is between 0° and 120°.

According to the example shown in FIG. 3, the converging point of the two small strips 9*a*, 9*b* or 10*a*, 10*b* of each cramping member is close to the hole 2 which they surround. As a variant, cramping members 9*a*, 9*b* and 10*a*, 10*b* may be slightly offset longitudinally with respect to the position illustrated in FIG. 3, but in any case, the major part of the small strips is situated with respect to a hole 2 on the side of the longitudinal middle of plate 1.

It is shown in FIG. 3 that the free edge 11 of the metal strips 9a, 9b and 10a, 10b is a cutting edge which is bevel-cut or sharpened so as to readily penetrate into the wood when the fish-plate 1 is in position.

To give a non-restrictive idea of sizes, metal strips 9a, 9b, 10a, 10b are flat iron bars of 60 mm length, 2 to 6 mm thickness, and 10 to 40 mm height, which are welded on the rear face of each fish-plate.

FIG. 4 illustrates a variant embodiment in which the internal face of each fish-plate 1 comprises four cramping members 12, each one composed of a length of channel plate, the web of which is welded or screwed on the internal face of the fish-plate 1, and the sides extend perpendicularly therefrom and in parallel to the longitudinal axis x–x1 of fish-plate 1.

FIG. 4 illustrates an example in which each cramping member is entirely offset towards the longitudinal middle of the fish-plate 1 with respect to the hole 2 to which it is associated.

As a variant, each cramping member 12 can overlap the hole 2 and in this case the web of the channel plate is also perforated to allow the passage of the bolt.

The embodiment shown in FIG. 4 corresponds to that shown in FIG. 3 in the case where the angle $\alpha=0°$.

The example shown in FIG. 4 in which the two metal strips of each pair form part of one and the same piece, is applicable to the embodiment shown in FIG. 3, and if, vice-versa, the two metal strips of each cramping member are parallel, as shown in FIG. 4, they can be separate one from the other as illustrated in FIG. 3.

Figure 5:
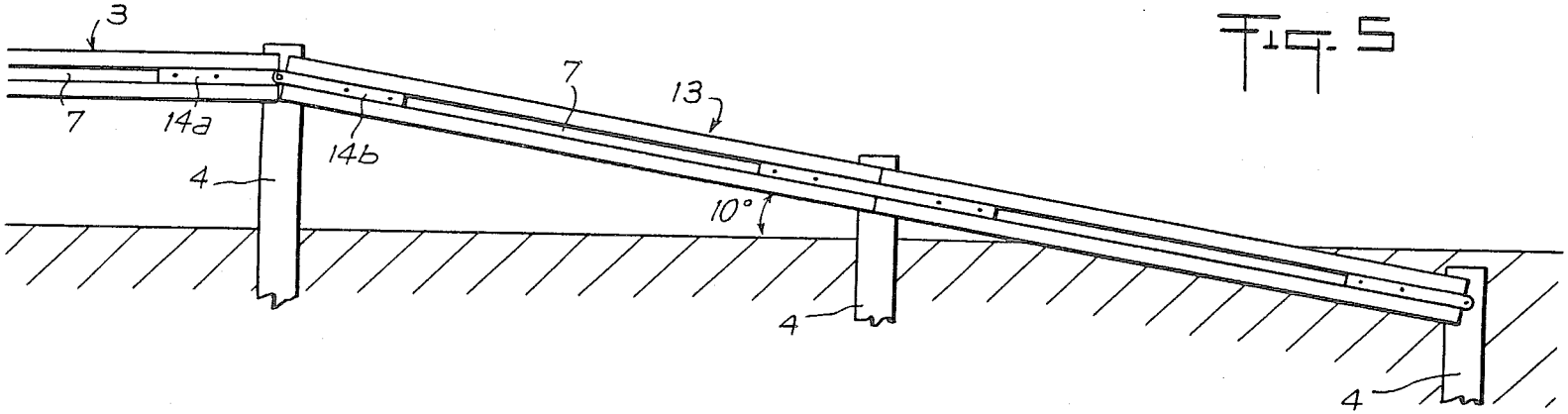
FIG. 5 is an elevational view of one end of a crash barrier according to the invention.
Figure 6:
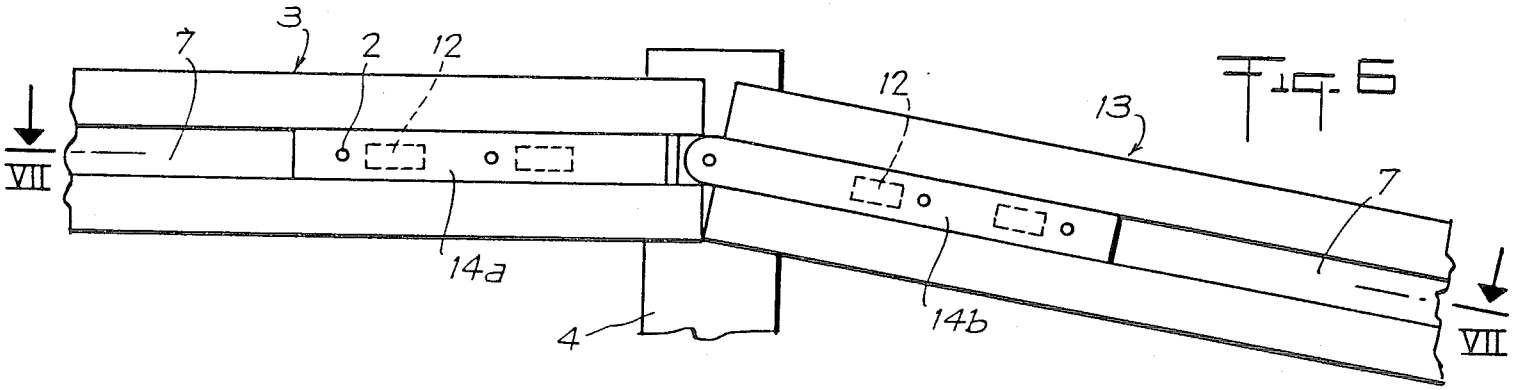
FIG. 6 is an elevational view showing, on an enlarged scale, the assembling of the inclined rail with the end of the horizontal rail according to FIG. 5.
Figure 7:
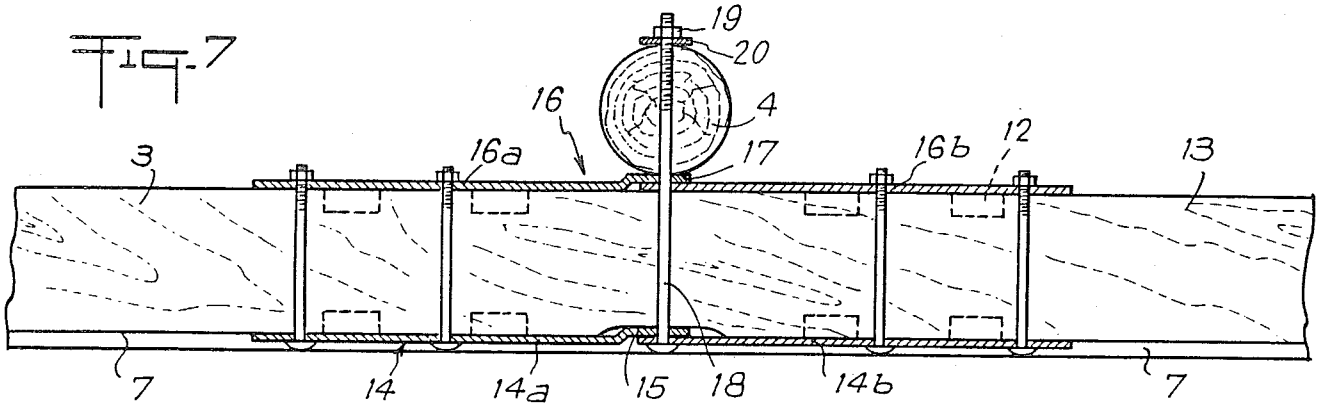
FIG. 7 is a cross-section along line VII—VII of FIG. 6.

FIGS. 5, 6 and 7 show one end of a crash barrier according to the invention. The left side of the figures shows the end of the horizontal guard rail 3 which is extended towards the right by an inclined rail 13 going down towards the ground and forming for example an angle of 10° with the horizontal.

The guard rails 3 and 13 are constituted of poles in injected wood of constant diameter and are supported by posts 4.

FIGS. 6 and 7 show, on an enlarged scale, the junction between the juxtaposed ends of the horizontal guard rail 3 and of the inclined rail 13.

It is seen from the figures that assembly of two juxtaposed poles is achieved by means of two elongated fish-plates situated on either side of the poles in the horizontal plane of the axis of said poles.

Each fish-plate is composed of two portions. For example, fish-plate 14, situated on the road side, is composed of two portions 14a and 14b, each one comprising two holes 2 for the passage of the bolts securing the fish-plates to one of the poles. One end 15 of portion 14a is bent over twice, so that it is superposed on the end of portion 14b.

Likewise, fish-plate 16 situated on the site opposite to the road is composed of two portions 16a, 16b and one end 17 of portion 16a is bent over twice and is superposed on the end of portion 16b.

The ends 15 and 17, as well as the ends of portions 14b and 16b are perforated with a hole through which passes a mounting bolt 18 which is engaged in the empty space between the adjacent ends of the two poles due to the inclination of pole 13 and which traverses the post 4 situated on the junction between the end of the horizontal rail and the beginning of the inclined rail. A nut 19 is screwed on the threaded end of the bolt 18 situated at the back of the post, said nut cooperating with a washer 20 pressed against the post 4.

The two portions of each fish-plate are thus articulated together, this permitting a variation of the angle of inclination of the inclined barrier.

FIGS. 6 and 7 represent in dotted lines, the cramping member 12 according to FIG. 4, anchored in the wood to prevent said wood from splitting.

The portions 14a and 14b of fish-plate 14 situated on the road side, are placed inside a groove 7.

FIG. 8 shows a horizontal section cutting through the axial horizontal plane of the poles of a portion of crash barrier according to the invention installed along a curve in a road. Said figure shows two adjacent poles 3a, 3b forming an angle between them.

The adjacent ends of these two poles are joined together by two fish-plates 21a, 21b which are bent over in the horizontal plane according to an angle $\beta$, of 6° for example. As in the preceding cases, each fish-plate comprises four holes for the passage of four bolts 6, each bolt traversing two fish-plates and one of the poles. Fish-plate 21a and the bolt heads situated on the road side are contained in a groove 7.

In order to adapt the crash barrier to road curves of different radii, it suffices to vary the bending of the fish-plates and the length of the poles. For example, if the radius of curvature of the road is less than 14 meters, poles of 1.50 m length are used with fish-plates bent at 6°. If the radius of curvature is between 14 m and 19 m, poles of 2 m length are used with fish-plates bent at 6°. If the radius of curvature is between 19 m and 24 m, the poles are 2.50 m long and the fish-plates are bent at 6°. For radii of curvature between 24 m and 50 m, the poles are 2.50 m long and the bending angle of the fish-plates is 3°. For radii of curvature above 50 m, the poles are 2.50 m long and the folding angle of the fish-plates is less than 3°.

The foregoing description illustrates crash barriers with only one guard rail. But this is in no way restrictive of the invention in which the crash barrier can comprise a plurality of horizontal guard rails of same composition.

What is claimed is:

1. A crash barrier for roads or highways, of the type comprising at least a horizontal guard rail in wood which is composed of elements assembled end to end and supported by wooden posts, wherein said guard rail is composed of wooden poles, each one having two ends, the adjacent ends of which poles are assembled together end to end by means of two fish-plates consisting of two rectangular metal plates, elongated and flat, placed on either side of said poles, in the horizontal plane traversing their axis and across the junction between two poles, said fish-plates comprising a plurality of holes for receiving bolts which go through the plates and one of said poles, on each one of said bolts is screwed a nut.

2. A crash barrier as claimed in claim 1, wherein each wooden pole comprises a longitudinal groove situated on the road side and having a width and depth slightly more than the width and thickness of said metallic plates, one of said two metallic plates being housed in said groove.

3. A crash barrier as claimed in claim 1, wherein each fish-plate is provided, on its internal face, with cramping members, each one comprising a pair of small thin metal strips situated in planes perpendicular to that of the fish-plate, and each cramping member is associated to one of said holes and is for the main part situated on the same side of said hole as the longitudinal middle of the fish-plate, whereby the two small strips of each cramping member penetrate into the wood of the pole when the fish-plate is in position, and tightens the fibers of said wood, whereby the wood is prevented from splitting when a tractive force is exerted on the fish-plate.

4. A crash barrier as claimed in claim 3, wherein the two small strips of each pair form together an angle varying between 0° and 120°.

5. A crash barrier as claimed in claim 3, wherein the free edge of each strip is a cutting edge.

6. A crash barrier as claimed in claim 4, wherein each cramping member is composed of two metal strips converging towards each other and towards the nearest end of the fish-plate, said strips being symmetrical with respect to the longitudinal axis of said plate.

7. A crash barrier as claimed in claim 3, wherein each cramping member is constituted by a channel bar the web thereof being secured to the back of the fish-plate whereas the sides are parallel to the longitudinal axis of the fish-plate.

8. A crash barrier as claimed in claim 1, wherein the assembly of two poles, one constituting one end of a horizontal guard rail, and the other, the beginning of an inclined guard rail, consists of two fish-plates, each one being composed of two portions articulated on a bolt passing through the free space between the two poles and traversing a post placed at the rear of the junction between said two poles.

9. A crash barrier as claimed in claim 1, placed along a curve in a road, wherein said barrier is composed of poles of length varying with the radius of curvature of the road, said poles being assembled by means of two fish-plates bent according to an angle varying with the radius of curvature of the road.

10. A crash barrier as claimed in claim 1, wherein said guard rail is secured to each of said posts by a bolt traversing said post, the head of said bolt rests against the fish-plate situated on the side opposite to the road.

11. Crash barrier as claimed in claim 1, wherein the poles constituting said posts and said rail elements have a constant diameter, the diameter of said posts being smaller than the diameter of the rail elements.

* * * * *